US009603435B2

(12) United States Patent
Ishida

(10) Patent No.: US 9,603,435 B2
(45) Date of Patent: Mar. 28, 2017

(54) STICK-LIKE MATERIAL FEEDING CONTAINER

(71) Applicant: TOKIWA CORPORATION, Nakatsugawa-shi, Gifu (JP)

(72) Inventor: Yukikazu Ishida, Kawaguchi (JP)

(73) Assignee: TOKIWA CORPORATION, Nakatsugawa-Shi (JP)

( * ) Notice: Subject to any disclaimer, the term of this patent is extended or adjusted under 35 U.S.C. 154(b) by 0 days.

(21) Appl. No.: 14/790,357

(22) Filed: Jul. 2, 2015

(65) Prior Publication Data

US 2016/0000207 A1 Jan. 7, 2016

(30) Foreign Application Priority Data

Jul. 4, 2014 (JP) ..... 2014-138446

(51) Int. Cl.
*A45D 40/20* (2006.01)
*A45D 40/02* (2006.01)

(52) U.S. Cl.
CPC ..... *A45D 40/205* (2013.01); *A45D 40/02* (2013.01); *A45D 2040/208* (2013.01)

(58) Field of Classification Search
CPC combination set(s) only.
See application file for complete search history.

(56) References Cited

U.S. PATENT DOCUMENTS 3,045,593 A * 7/1962 Petterson ..... B43K 8/026 101/368
7,455,467 B2 * 11/2008 Sasaki ..... A45D 40/04 401/68

FOREIGN PATENT DOCUMENTS

JP 4620606 B2 1/2011

* cited by examiner

*Primary Examiner* — David Walczak
(74) *Attorney, Agent, or Firm* — Westerman, Hattori, Daniels & Adrian, LLP

(57) ABSTRACT

At a distal end of a pipe member 4, a plurality of projections 4*n* are disposed circumferentially. The projection 4*n* extends frontward in an axial direction. At a tip end of a leading tube 3, a groove forming section G is disposed. The groove forming section G includes a plurality of grooves 3*n* circumferentially in an inner peripheral surface. The grooves 3*n* extend in the axial direction. The projection 4*n* of the pipe member 4 enters the groove 3*n*. At the leading tube 3, an inner diameter of a convex part 3*p* between the grooves 3*n* and 3*n* circumferentially arranged and an inner diameter of a pipe part that houses the projection 4*n* of the pipe member 4 and the stick-like material rearward with respect to this projection 4*n* of the pipe member are identical size.

1 Claim, 25 Drawing Sheets

STICK-LIKE MATERIAL FEEDING CONTAINER

TECHNICAL FIELD

The present invention relates to a stick-like material feeding container provided to feed a stick-like material for use.

BACKGROUND ART

As a stick-like material feeding container provided to feed a stick-like material (stick-like body) housed in a container in two phases using two pieces of screw parts to appear the stick-like material from an opening at a container distal end for use, the container described in the following Patent Literature 1 has been known. This stick-like material feeding container described in Patent Literature 1 has the leading tube. The leading tube is mounted to the distal end side of the container main body so as to be relatively rotatable. The leading tube internally houses the pipe member. The pipe member internally houses the slidable stick-like material. The relative rotation of the container main body and the leading tube in the feed direction first activates the screwing action by the first screw part. When the screw member is fed and advances, together with the screw member, the pipe member advances. When the screw member reaches the advance limit in the leading tube and the screwing action by the first screw part is stopped, the screwing action by the second screw part is activated. The screwing action feeds and advances the movable body. This extrudes the stick-like material in the pipe member, and the stick-like material projects from the opening at the distal end of the leading tube, thus ensuring providing the stick-like material for use. The relative rotation of the container main body and the leading tube in the feedback direction activates the screwing action by the first screw part. When the screw member is fed back from the advance limit and retreats, together with the screw member, the pipe member retreats. Thus, the stick-like material sinks from the opening of the leading tube to the inside of the leading tube.

CITATION LIST

Patent Literature

Patent Literature 1: Japanese Patent No. 4620606

SUMMARY OF INVENTION

Problems to be Solved by the Invention

Here, with the stick-like material feeding container, after using the stick-like material projecting from the top end surface of the pipe member, if the container main body and the leading tube are relatively rotated in the feedback direction, the screwing action by the first screw part retreats the pipe member from the advance limit, and the stick-like material sinks in the leading tube, a region between the top end surface of the pipe member retreated from the advance limit of the leading tube and this advance limit is a space for the pipe member to advance and retreat. Therefore, while the pipe member retreats from the advance limit, the stick-like material projected from the top end surface of the pipe member is not radially supported across the whole circumference in the space. Accordingly, if an impact or a vibration is applied to the container, the stick-like material projecting from the top end surface of the pipe member swings at the space, possibly resulting in a snap of the stick-like material. Especially, in the case where the viscosity of the stick-like material is soft and the stick-like material has a thin diameter, a possibility of snap increases.

Therefore, it is an object of the present invention to provide a stick-like material feeding container that can prevent the stick-like material from snapping even if the container is impacted or vibrated.

Solution to Problems

A stick-like material feeding container according to the present invention includes a leading tube, a container main body, a pipe member, a movable body, and a screw member. The leading tube has an opening at a distal end. The leading tube has a first female screw in an inner peripheral surface. To the container main body, the leading tube is mounted to be relatively rotatable. The pipe member is disposed in the leading tube. A stick-like material is filled into a pipe part of the pipe member. The movable body includes a piston and a shaft part. The piston is movable in the pipe member to extrude the stick-like material. The shaft part has a second male screw at an outer peripheral surface. The screw member includes a first male screw at an outer peripheral surface and a second female screw at an inner peripheral surface. The first male screw is screwed with the first female screw of the leading tube to constitute a first screw part. The second female screw is screwed with the second male screw of the movable body to constitute a second screw part. The relative rotation of the leading tube and the container main body advances or retreats the screw member together with the pipe member by a screwing action by the first screw part. Meanwhile, when the screw member and the pipe member advance as predetermined, a screwing action by the second screw part advances the movable body to extrude the stick-like material to ensure projecting the stick-like material from the opening of the leading tube. At a distal end of the pipe member, a plurality of projections are disposed circumferentially. The projections extend frontward in an axial direction. At a tip end of the leading tube, a groove forming section is disposed. The groove forming section includes a plurality of grooves circumferentially in an inner peripheral surface. The grooves extend in an axial direction. The projection of the pipe member enters the groove. At the leading tube, an inner diameter of a convex part between the grooves circumferentially arranged and an inner diameter of a pipe part that houses the projection of the pipe member and the stick-like material rearward with respect to this projection of the pipe member are identical size. The screwing action by the first screw part advances or retreats a distal end of the projection of the pipe member within the groove forming section.

According to the stick-like material feeding container, at the distal end of the pipe member, the plurality of projections are disposed circumferentially. The projection extends frontward in the axial direction. At the tip end of the leading tube, the groove forming section is disposed. The groove forming section includes the plurality of grooves circumferentially in an inner peripheral surface. The grooves extend in the axial direction. The projection of the pipe member enters the groove. At the leading tube, an inner diameter of a convex part between the grooves circumferentially arranged and an inner diameter of a pipe part that houses the projection of the pipe member and the stick-like material rearward with respect to this projection of the pipe member are identical size. A constitution where an advance or a retreat of the pipe member moves distal ends of the projections of the pipe member within the groove forming section of the leading tube is employed. Even if the distal ends of the projections of the pipe member retreat rearward with respect to the distal ends of the grooves of the leading tube (even if the distal ends retreat more than the advance limit), this constitution circumferentially supports the stick-like material projecting from the projections of the pipe member at a plurality of portions by inner surfaces of the convex parts between the grooves in the groove forming section of the leading tube. This allows preventing the stick-like material from snapping even if the container is impacted or vibrated.

Advantageous Effects of Invention

Thus, according to the present invention, even if the container is impacted or vibrated, the stick-like material feeding container that can prevent the stick-like material from snapping can be provided.

DESCRIPTION OF EMBODIMENTS

Figure 1:
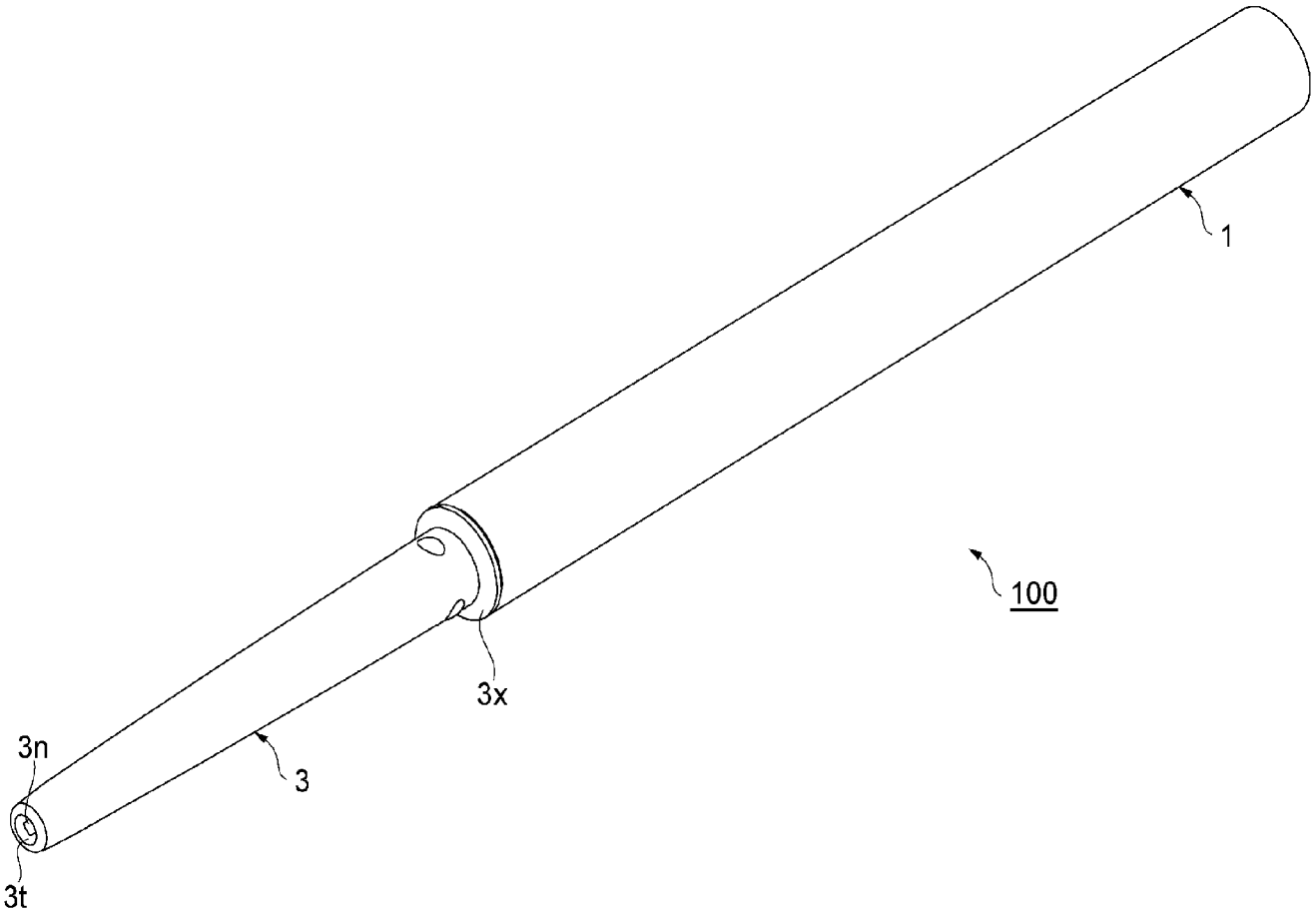
FIG. 1 is a front perspective view illustrating a stick-like material feeding container according to an embodiment of the present invention.
Figure 12:
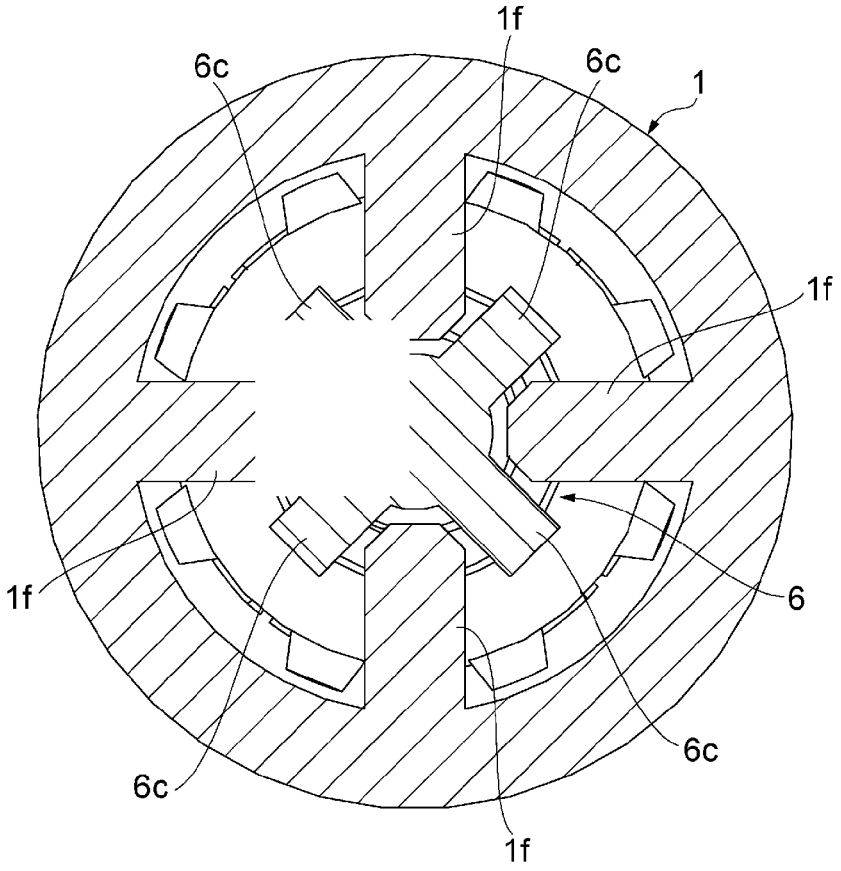
FIG. 12 is a drawing taken along an arrow XII-XII in FIG. 2.
Figure 13:
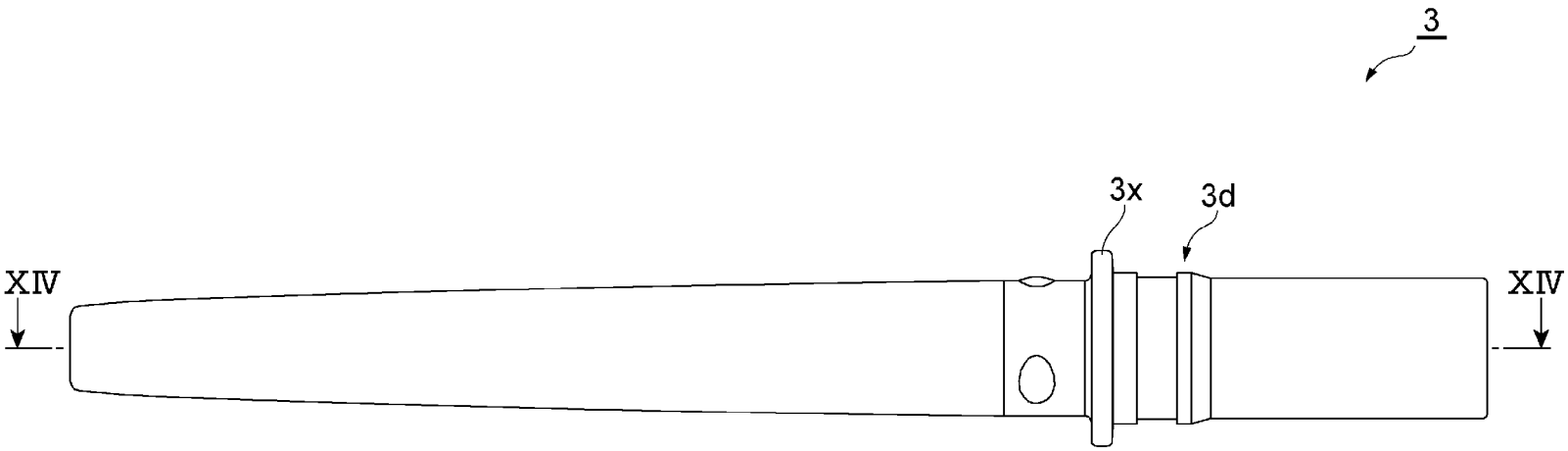
FIG. 13 is a side view illustrating the leading tube in FIG. 1 to FIG. 11.
Figure 14:
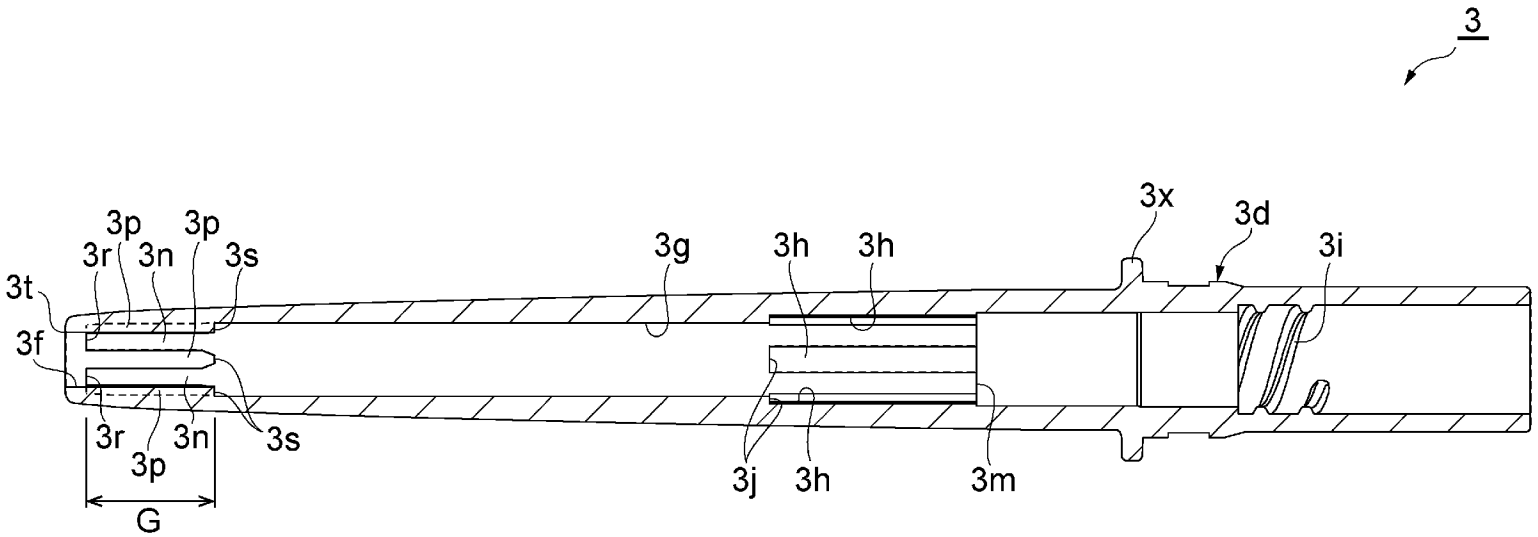
FIG. 14 is a drawing taken along an arrow XIV-XIV in FIG. 13.
Figure 15:
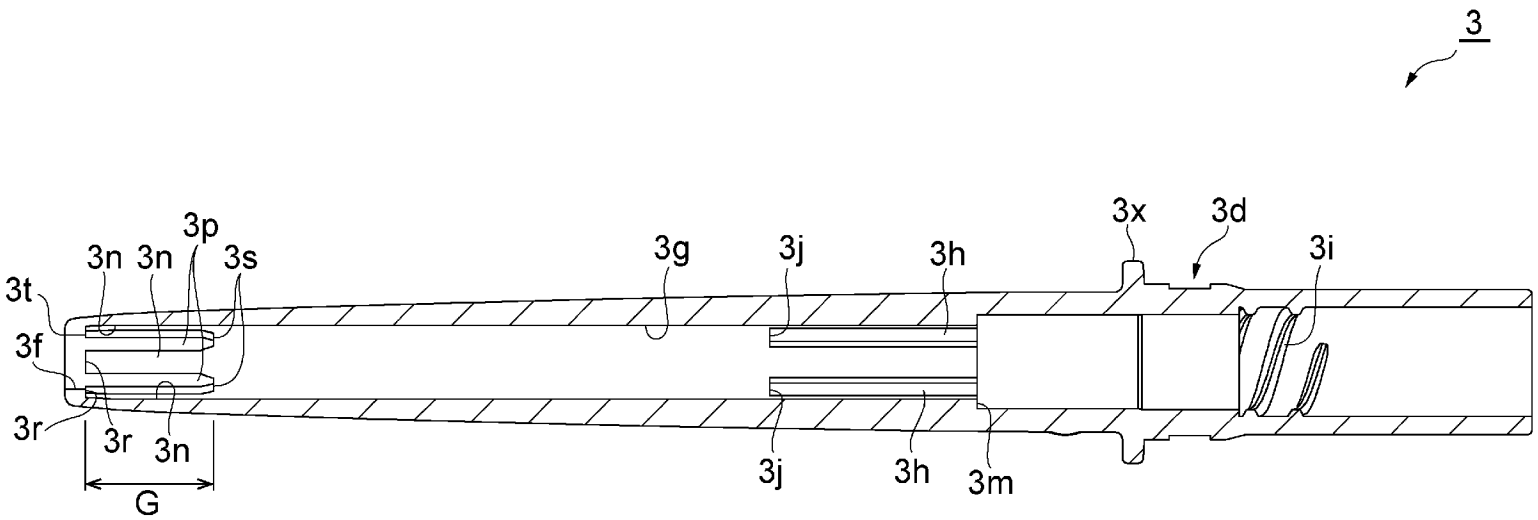
FIG. 15 is a cross-sectional view at a position rotated from the position in FIG. 14 by 45° and at which the groove is present at the leading tube.
Figure 16:
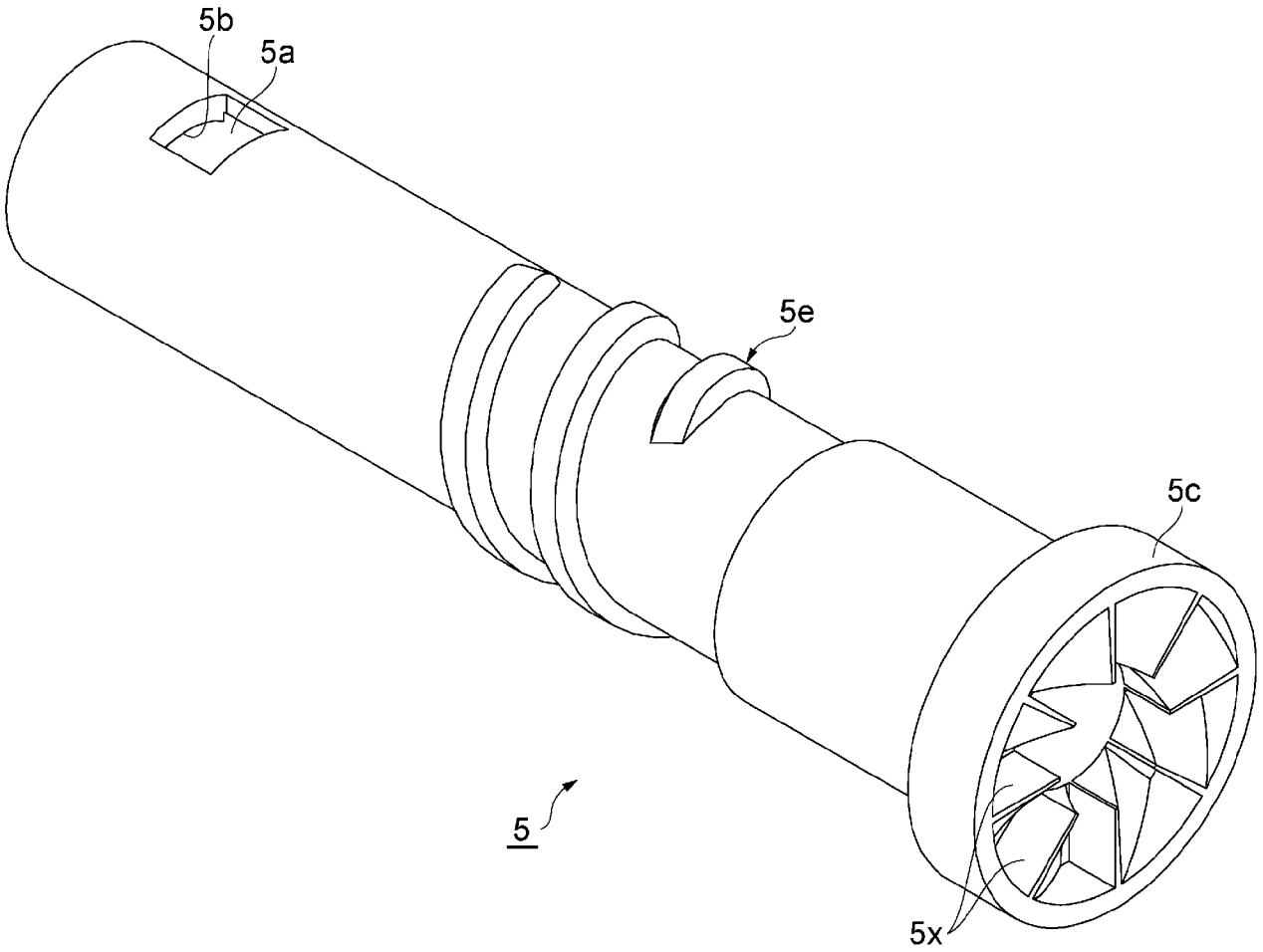
FIG. 16 is a rear perspective view illustrating a screw member in FIG. 2 to FIG. 11.
Figure 17:
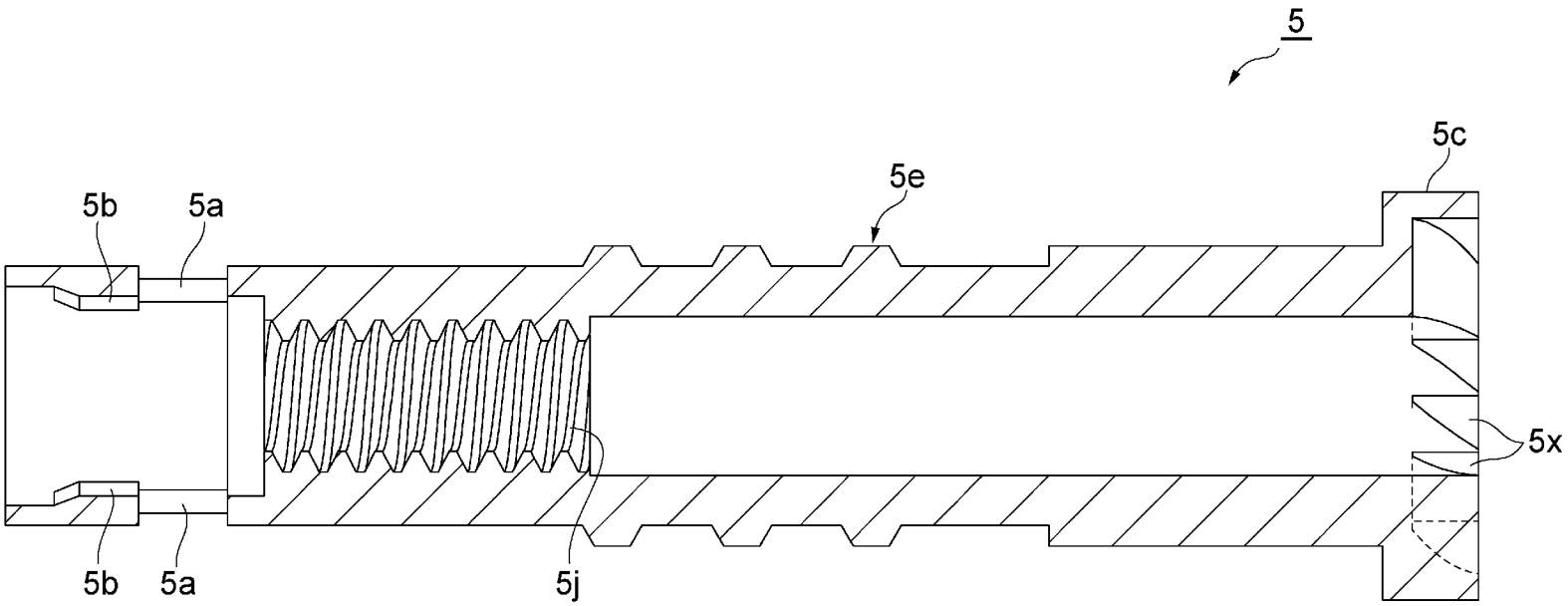
FIG. 17 is a cross-sectional view of the screw member illustrated in FIG. 16.
Figure 18:
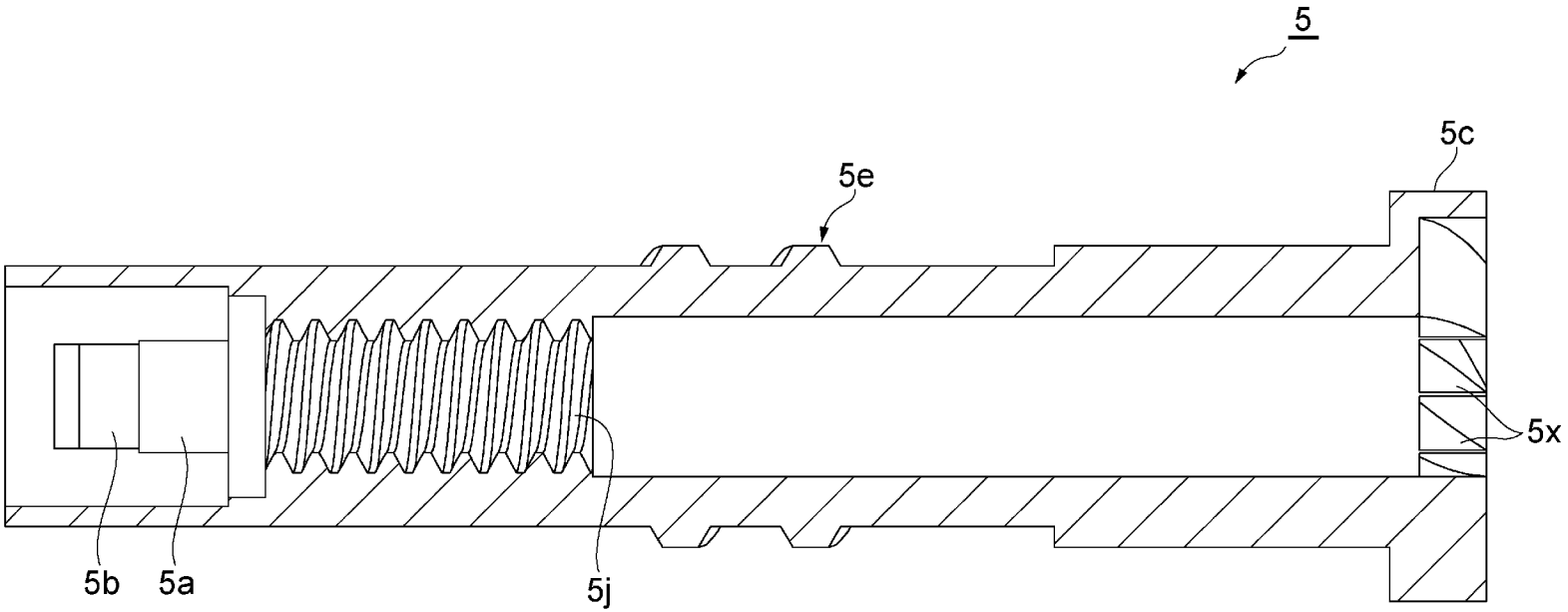
FIG. 18 is a cross-sectional view at a position rotated from the position in FIG. 17 by 90°.
Figure 19:
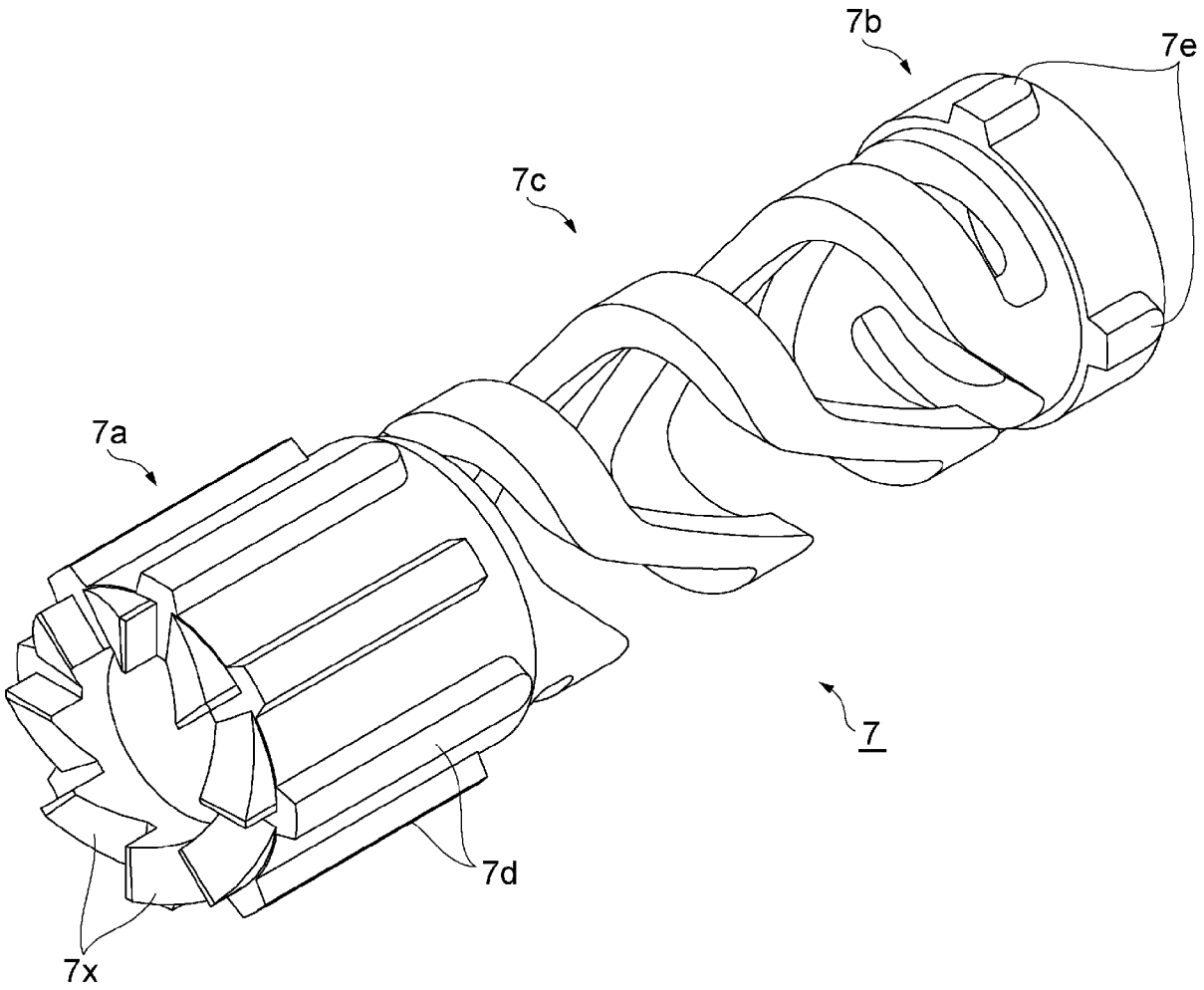
FIG. 19 is a front perspective view illustrating a ratchet spring member in FIG. 2 to FIG. 11.
Figure 20:
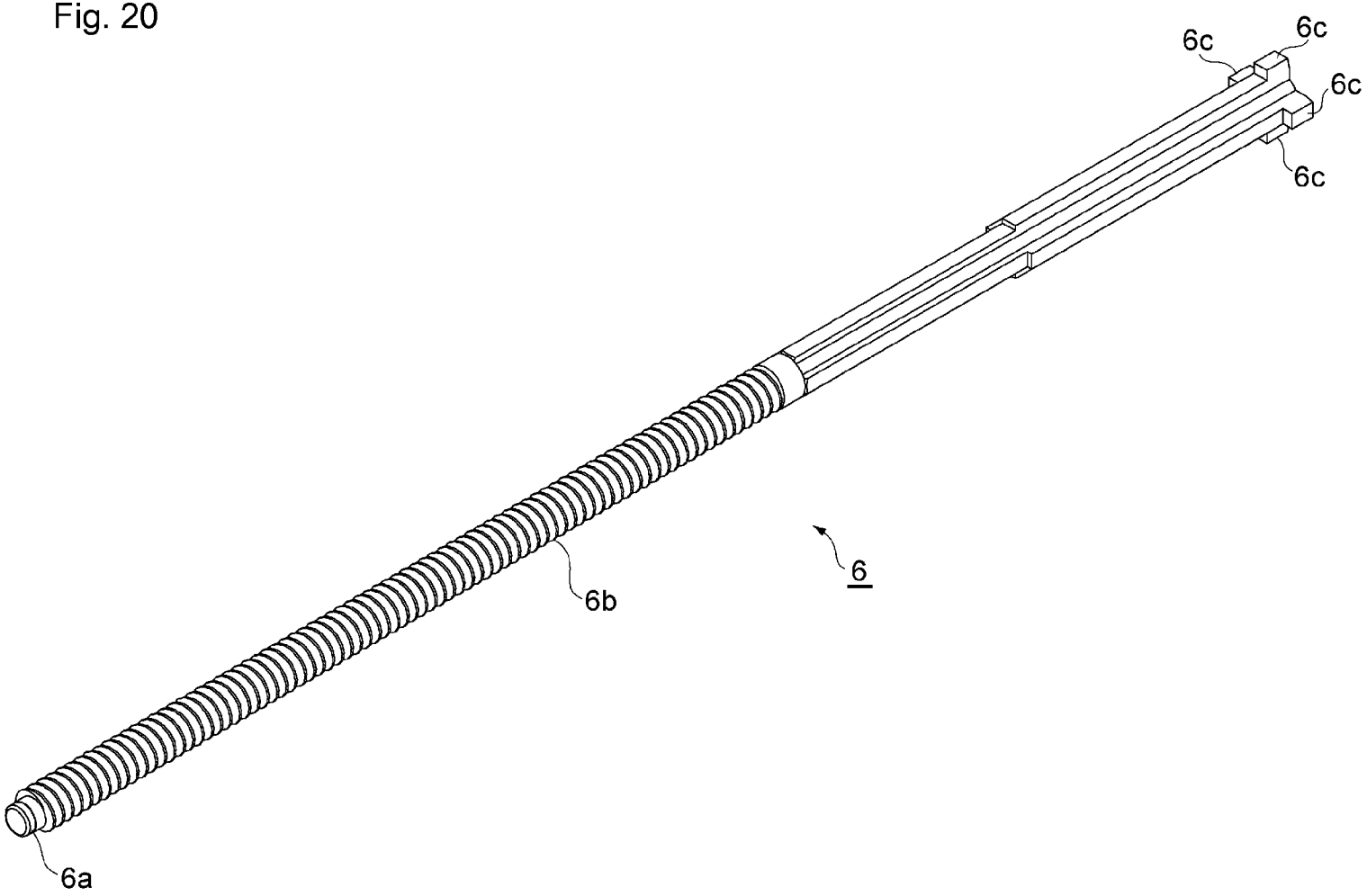
FIG. 20 is a front perspective view illustrating a movable body in FIG. 2 to FIG. 11.
Figure 21:
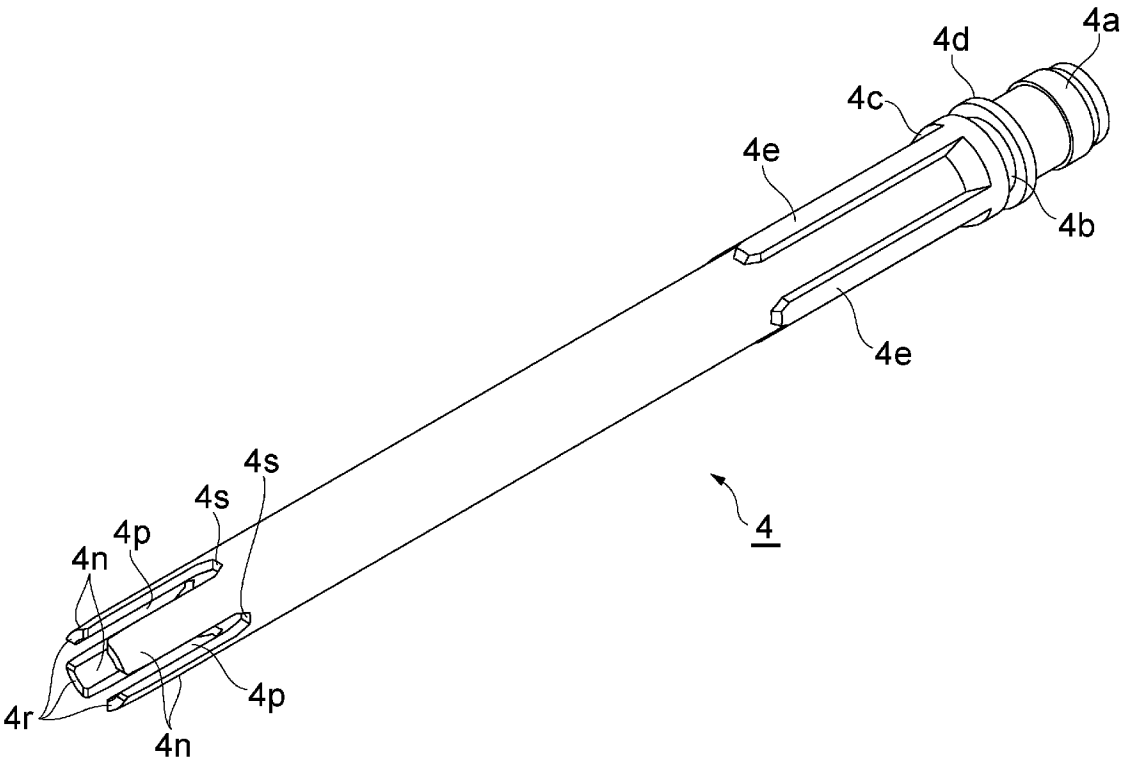
FIG. 21 is a front perspective view illustrating the pipe member in FIG. 2 to FIG. 11.
Figure 22:
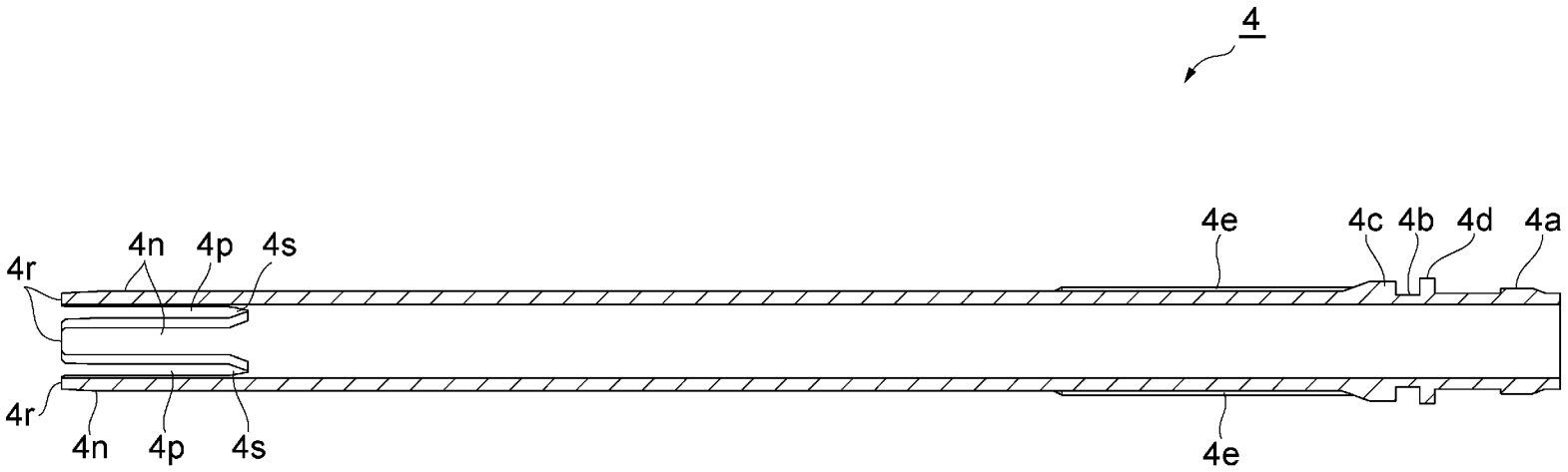
FIG. 22 is a cross-sectional view of the pipe member illustrated in FIG. 21.
Figure 23:
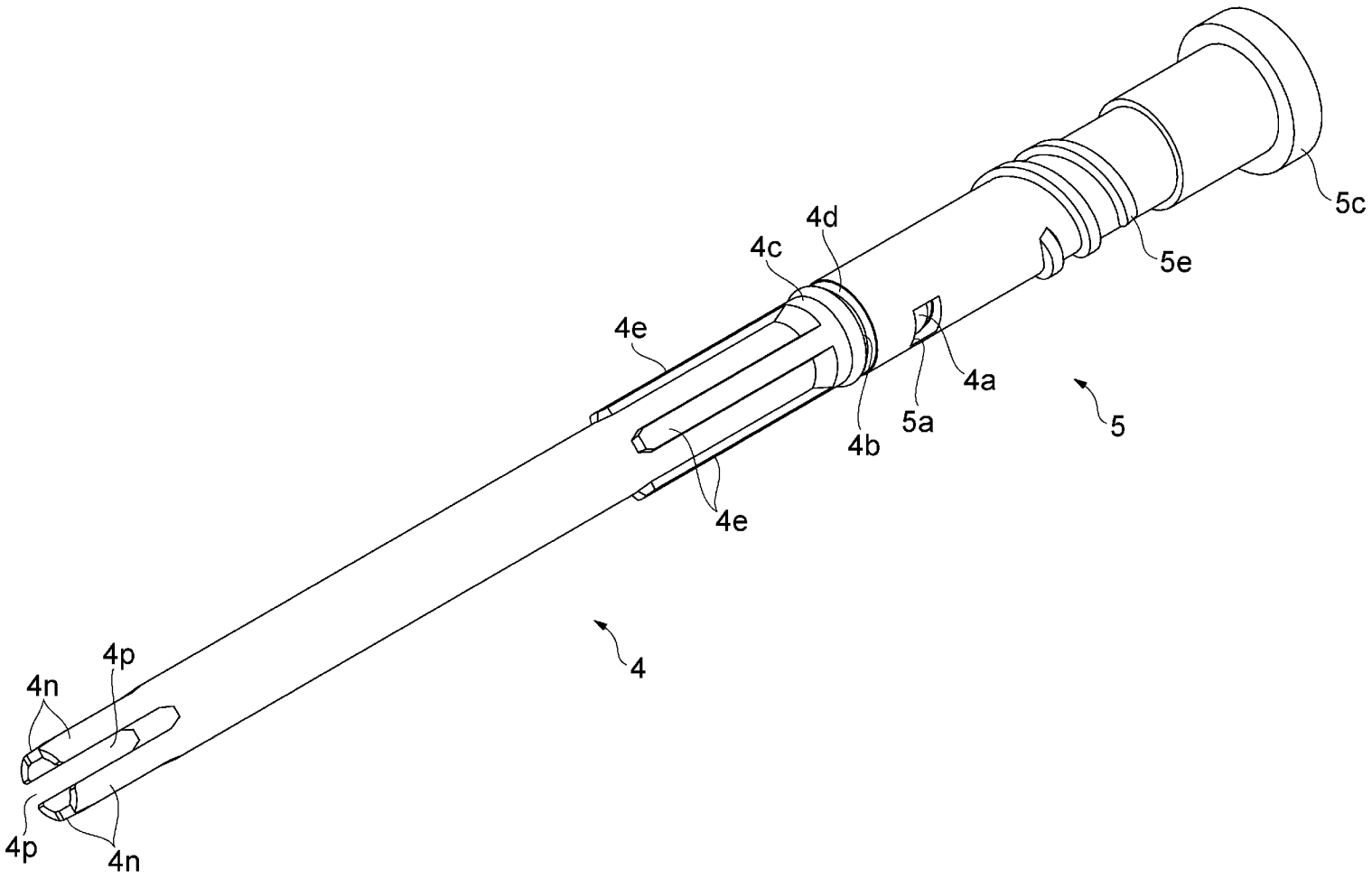
FIG. 23 is a front perspective view illustrating the screw member illustrated in FIG. 16 to FIG. 18 is coupled to the pipe member illustrated in FIG. 21 and FIG. 22.
Figure 24:
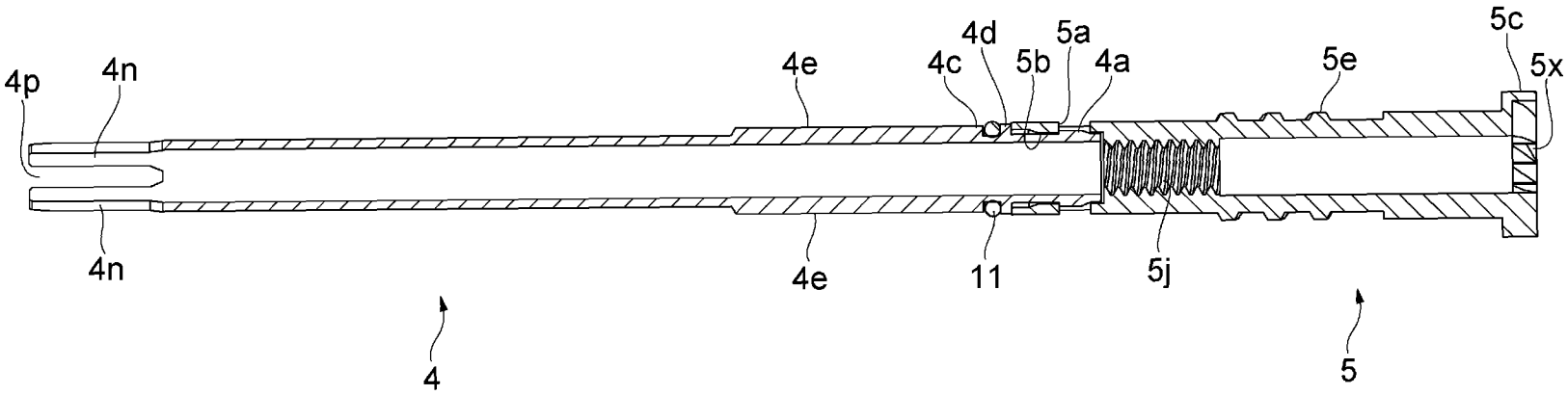
FIG. 24 is a cross-sectional view of FIG. 23.
Figure 25:
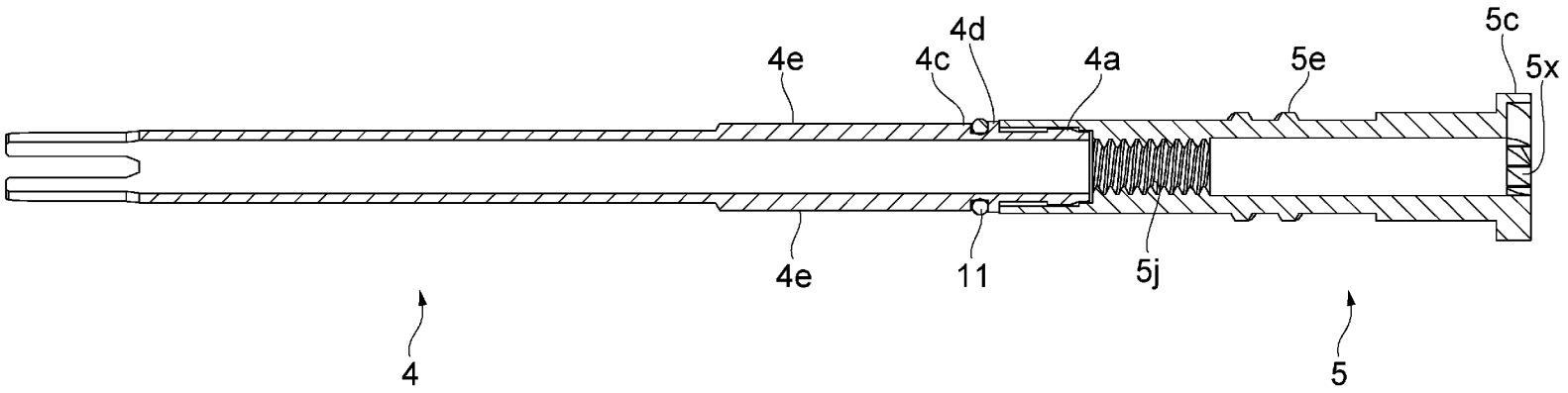
FIG. 25 is a cross-sectional view at a position rotated from the position in FIG. 24 by 90°.

A preferred embodiment of a stick-like material feeding container according to the present invention will be described below with reference to FIG. 1 to FIG. 25. FIG. 1 is a front perspective view illustrating a stick-like material feeding container according to an embodiment of the present invention. FIG. 2 to FIG. 5 are cross-sectional views each illustrating the stick-like material feeding container in an initial state. FIG. 6 to FIG. 8 are cross-sectional views each illustrating a stick-like material extruding state by a screwing action by a second screw part subsequent to the state illustrated in FIG. 2 to FIG. 5. FIG. 9 to FIG. 11 are cross-sectional views each illustrating a pipe member feedback state by a screwing action by a first screw part subsequent to the state illustrated in FIG. 6 to FIG. 8. FIG. 12 is a cross-sectional view illustrating an inside of a rear part of the stick-like material feeding container. FIG. 13 to FIG. 15 are drawings each illustrating the leading tube. FIG. 16 to FIG. 18 are drawings each illustrating the screw member. FIG. 19 is a front perspective view illustrating a ratchet spring member. FIG. 20 is a front perspective view illustrating a movable body. FIG. 21 and FIG. 22 are drawings each illustrating the pipe member. FIG. 23 to FIG. 25 are drawings each illustrating a state of coupling the pipe member and the screw member.

Figure 2:
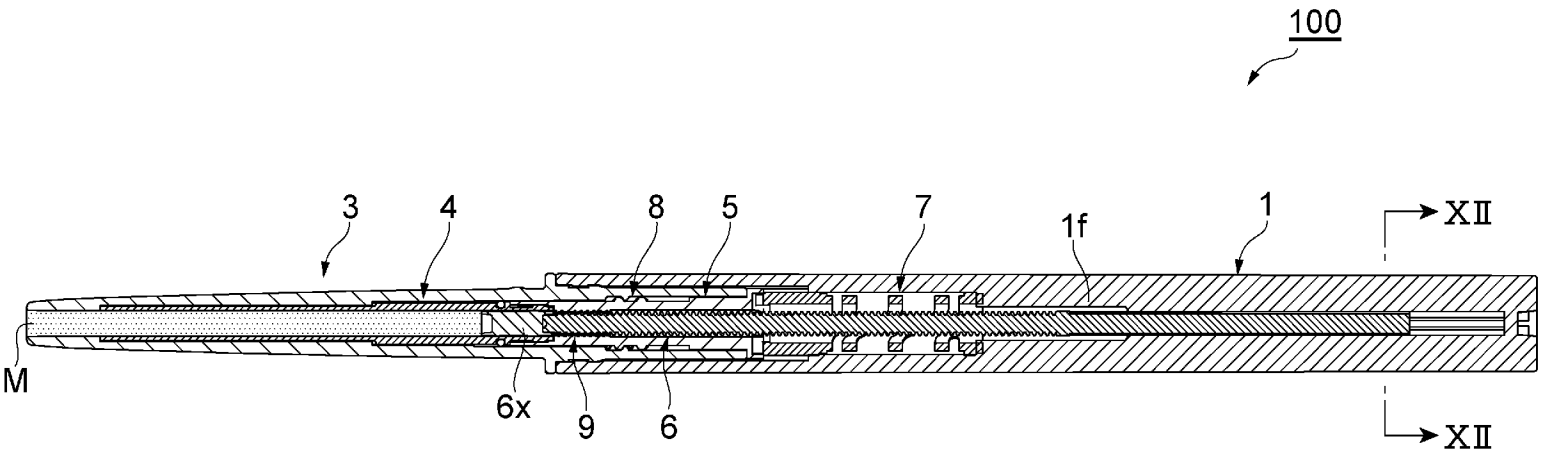
FIG. 2 is a cross-sectional view of the stick-like material feeding container illustrated in FIG. 1 and a cross-sectional view illustrating an initial state.
Figure 3:
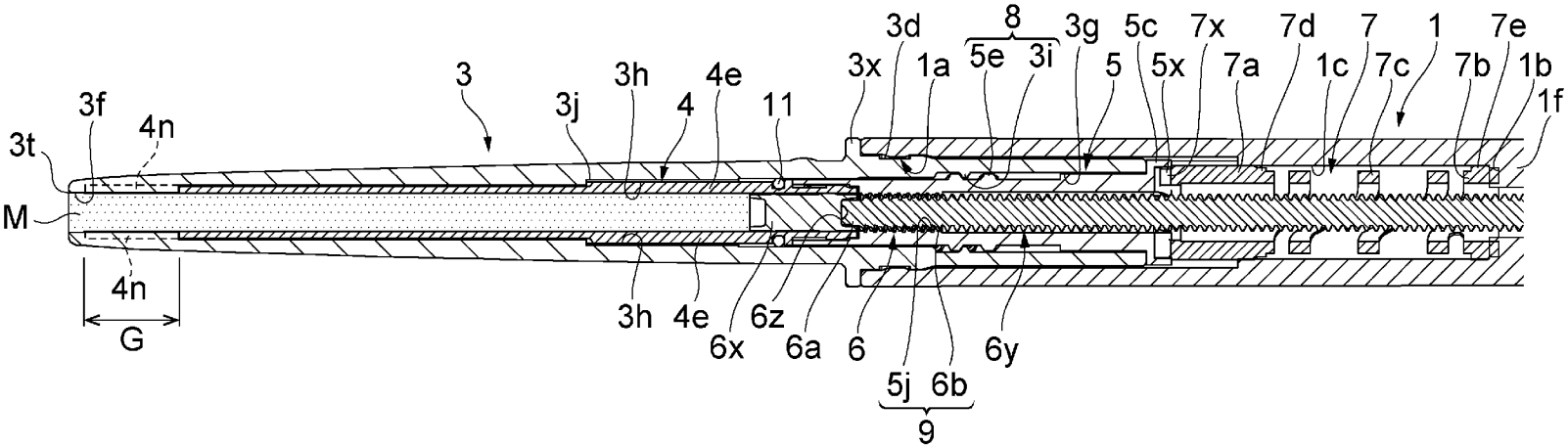
FIG. 3 is an enlarged cross-sectional view of a main part of the stick-like material feeding container illustrated in FIG. 2.
Figure 4:
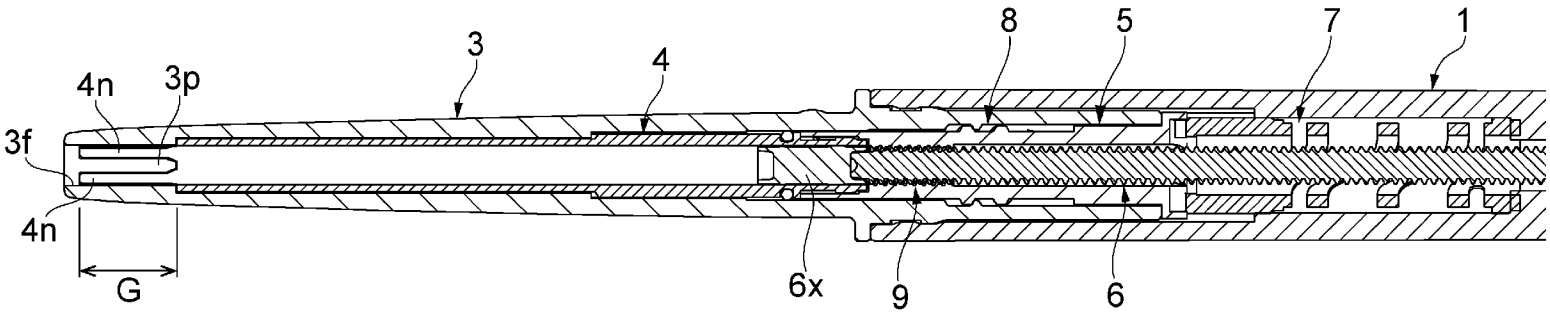
FIG. 4 is a cross-sectional view illustrating a state of no stick-like material in FIG. 3.
Figure 5:
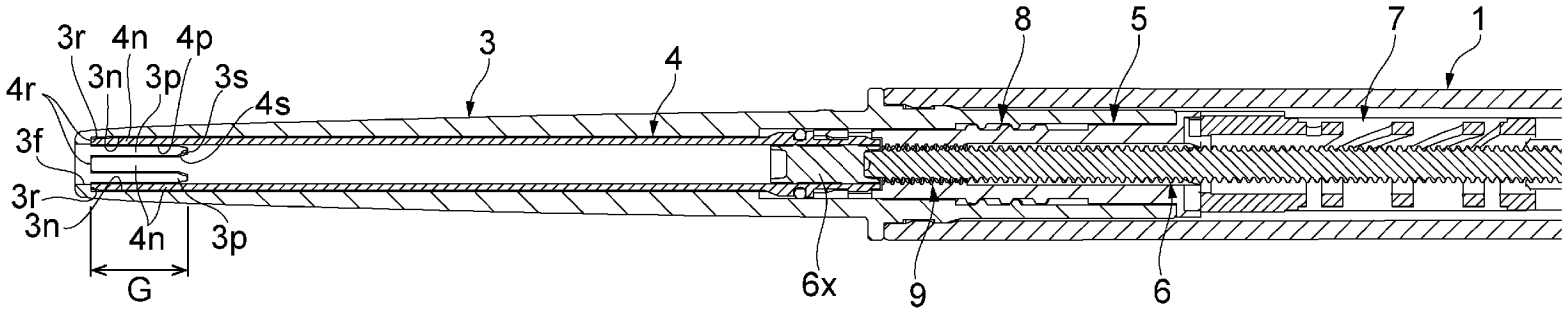
FIG. 5 is a cross-sectional view at a position rotated from the position in FIG. 4 by 45° and at which a groove is present at a leading tube.
Figure 6:
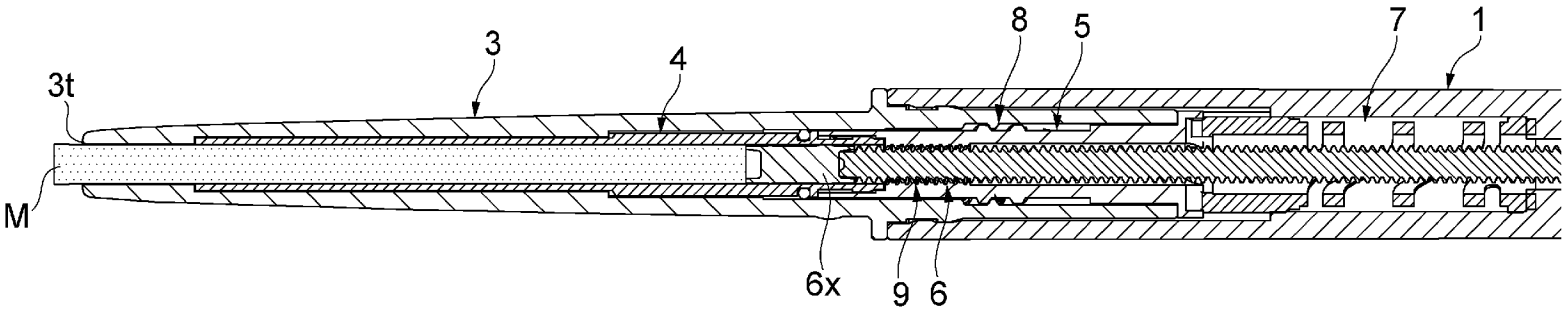
FIG. 6 is a cross-sectional view illustrating a stick-like material extruding state where a rotation operation by a user extrudes the stick-like material from the state illustrated in FIG. 3.
Figure 7:
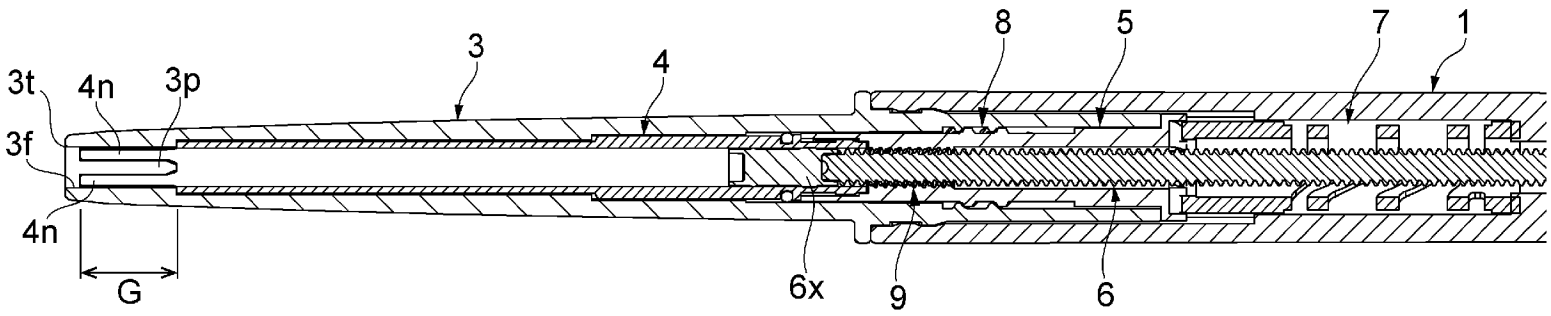
FIG. 7 is a cross-sectional view illustrating a state of no stick-like material in FIG. 6.
Figure 8:
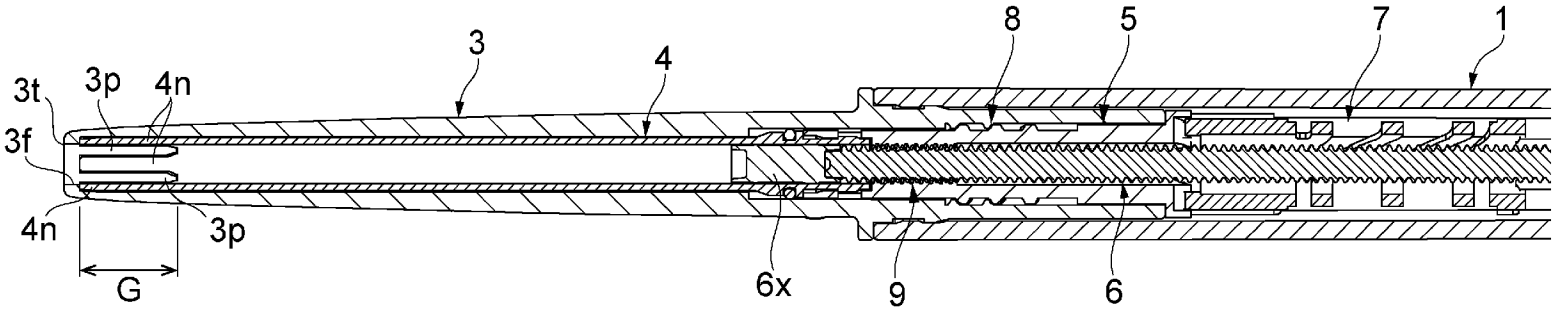
FIG. 8 is a cross-sectional view at a position rotated from the position in FIG. 7 by 45° and at which the groove is present at the leading tube.
Figure 9:
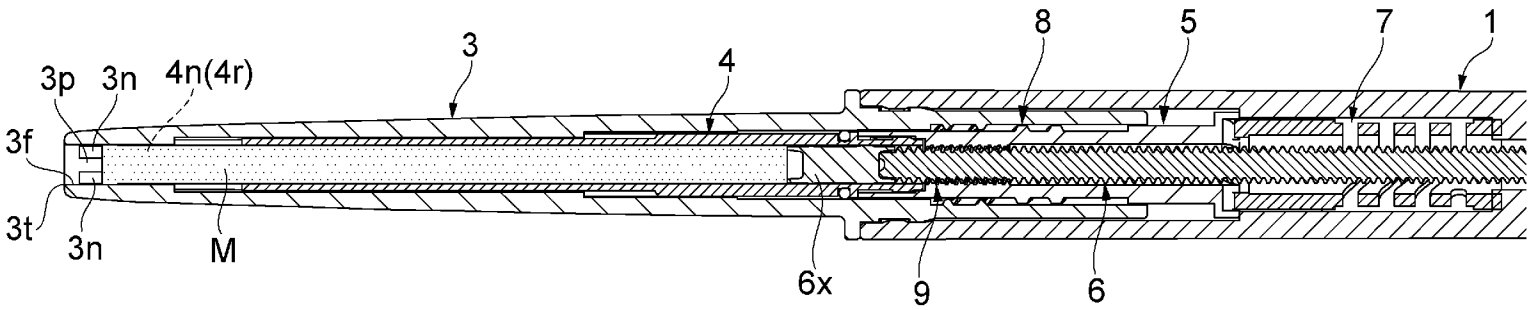
FIG. 9 is a cross-sectional view illustrating a pipe member feedback state where the rotation operation by the user feeds back the pipe member from the state illustrated in FIG. 6.
Figure 10:
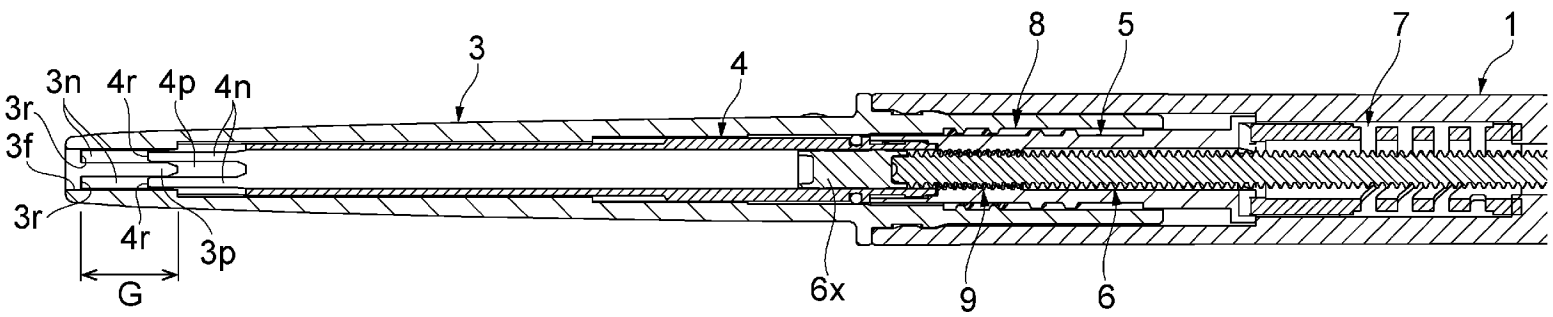
FIG. 10 is a cross-sectional view illustrating a state of no stick-like material in FIG. 9.
Figure 11:
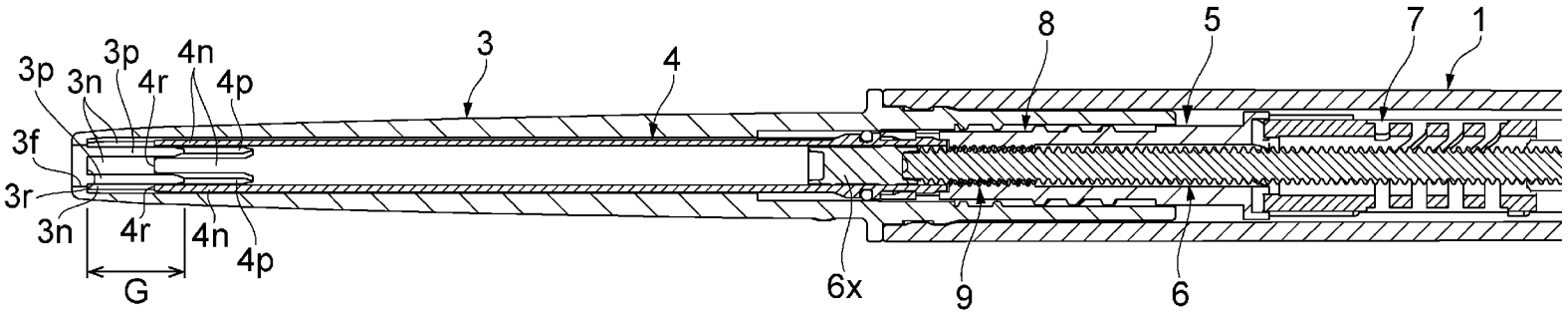
FIG. 11 is a cross-sectional view at a position rotated from the position in FIG. 10 by 45° and at which the groove is present at the leading tube.

For easy understanding of structures and operations, in the cross-sectional views of the stick-like material feeding container illustrated in FIG. 2 to FIG. 11, among FIG. 2 to FIG. 5, which illustrate the initial state, FIG. 4 and FIG. 5 illustrate the state of no stick-like material. FIG. 4 illustrates the cross section at the position of no groove at the leading tube. FIG. 5 illustrates the cross section at the position with groove at the leading tube. Among FIG. 6 to FIG. 8, which illustrate the stick-like material extruding state, FIG. 7 and FIG. 8 illustrate the state of no stick-like material. FIG. 7 illustrates the cross section at the position of no groove at the leading tube. FIG. 8 illustrates the cross section at the position with groove at the leading tube. Among FIG. 9 to FIG. 11, which illustrate the pipe member feedback state, FIG. 10 and FIG. 11 illustrate the state of no stick-like material. FIG. 10 illustrates the cross section at the position of no groove at the leading tube. FIG. 11 illustrates the cross section at the position with groove at the leading tube.

Here, in this embodiment, the stick-like material is a stick-like cosmetic material, and the stick-like material feeding container is a stick-like cosmetic material feeding container. Since the application of the present invention to the stick-like cosmetic material, which especially easily snaps, is effective, here, the stick-like cosmetic material of soft viscosity and thin diameter is employed as the stick-like cosmetic material. However, it is only necessary that the stick-like cosmetic material is applicable to the present invention.

As illustrated in FIG. 1, a stick-like cosmetic material feeding container 100 as a stick-like material feeding container includes a container main body 1 and a leading tube 3 as an external configuration. The container main body 1 forms the rear half part of the container. The leading tube 3 forms the front half part of the container. The leading tube 3 is coupled to the container main body 1 to relatively rotatable and immovable in an axial direction. As illustrated in FIG. 2, the container internally includes a screw member 5, a pipe member 4, and a piston 6*x* at a distal end. The relative rotation of the container main body 1 and the leading tube 3 advances/retreats the screw member 5. The pipe member 4 houses a stick-like cosmetic material M. The pipe member 4 advances/retreats in association with the screw member 5 advancing/retreating. The piston 6*x* is fitted by being inserted into the pipe member 4 and abuts on the rear end surface of the stick-like cosmetic material M. The stick-like cosmetic material feeding container 100 roughly includes a movable body 6, a ratchet spring member 7, a first screw part 8, and a second screw part 9. The movable body 6 advances/retreats in association with the screw member 5 advancing/retreating. When the screw member 5 and the pipe member 4 reach an advance limit and the container main body 1 and the leading tube 3 further relatively rotate in the identical direction, the movable body 6 advances. The ratchet spring member 7 always biases the screw member 5 to the front side. In response to the relative rotation of the container main body 1 and the leading tube 3 after the screw member 5 and the pipe member 4 reach the advance limit, the ratchet spring member 7 provides a ratchet function with the screw member 5. The first screw part 8 allows the screw member 5 to advance/retreat. The second screw part 9 ensures the movement of the movable body 6.

The container main body 1 has a closed-bottomed cylindrical shape as illustrated in FIG. 1 and FIG. 2. As illustrated in FIG. 3, the container main body 1 includes a convexo-concave part 1*a* at an inner circumferential surface on the distal end side. The convexo-concave part 1*a* has an annular shape and unevenness arranged in the axial direction. The convexo-concave part 1*a* engages the leading tube 3 in the axial direction. As illustrated in FIG. 2, this container main body 1 has protrusions 1*f*. The protrusions 1*f* extend from a bottom part to the distal end side on the inner peripheral surface in an elongated manner. To engage the movable body 6 in a rotation direction, the plurality of (here, four pieces) protrusions 1*f* are equally arranged side by side circumferentially (see FIG. 12). As illustrated in FIG. 3, a top end surface 1*b* of the protrusion 1*f* is a stepped surface to cause the rear end surface of the ratchet spring member 7 to abut on. A plurality of grooves 1*c* are equally arranged side by side circumferentially on the inner peripheral surface on the front side with respect to the top end surface 1*b* of the container main body 1. The grooves 1*c* extend in the axial direction and engage the ratchet spring member 7 in the rotation direction.

As illustrated in FIG. 1 and FIG. 3, the leading tube 3 has a cylindrical shape. The leading tube 3 has a collar part 3*x* in the middle of the axial direction. The top end surface of the container main body 1 abuts on the collar part 3*x*. As illustrated in FIG. 3, a part on the rear side with respect to the collar part 3*x* of the leading tube 3 is an insertion part to be inserted into the container main body 1. A part on the front side with respect to the collar part 3*x* is a grip part gripped by a user during the relative rotation of the container main body 1 and the leading tube 3. As illustrated in FIG. 13 to FIG. 15, an annular concavo-convex part 3*d* is disposed on an outer peripheral surface close to the collar part 3*x* at the insertion part of the leading tube 3. The concavo-convex part 3*d* is engaged with the convexo-concave part 1*a* of the container main body 1 in the axial direction.

As illustrated in FIG. 14 and FIG. 15, a tube hole penetrating in the axial direction of the leading tube 3 from an opening at the distal end to a neighborhood of the distal end is a short stick-like cosmetic material hole 3*f*. Only the stick-like cosmetic material M advances and retreats through the stick-like cosmetic material hole 3*f*. The rear end of this stick-like cosmetic material hole 3*f* is followed by a groove forming section (The details are described later) G. From the rear end of this groove forming section to the rear end of the tube hole is a tube hole 3*g*. The tube hole 3*g* has diameter larger than the stick-like cosmetic material hole 3*f*. The tube hole 3*g* houses the pipe member 4 and the screw member 5. The pipe member 4 and the screw member 5 move (advance/retreat) in the tube hole 3*g*.

In the middle of the tube hole 3*g* in the axial direction, a stepped surface 3*m* is disposed. The diameter of the tube hole on the rear side with respect to this stepped surface 3*m* is larger than the diameter of the tube hole on the front side. On the stepped surface 3*m*, a plurality of (here, four pieces) grooves 3*h* are equally arranged side by side circumferentially. The grooves 3*h* extend from this stepped surface 3*m* to the front side in the axial direction to engage the pipe member 4 in the rotation direction. These grooves 3*h* also play a role in guiding projections 4*n* (The details are described later) of the pipe member 4 to accurately enter into grooves 3*n* (The details are described later) on the distal end side of the leading tube 3. In the tube hole 3*g*, the tube hole on the front side with respect to the stepped surface 3*m* exclusively houses the pipe member 4. In the tube hole 3*g*, the tube hole on the rear side with respect to the stepped surface 3*m* exclusively houses the screw member 5. A distal end 3*j* constituting the groove 3*h* may be the stepped surface corresponding to the advance limit of the pipe member 4. Then, a female screw (spiral groove) 3*i* is disposed at the inner peripheral surface rearward with respect to the collar part 3*x* of the leading tube 3. The female screw 3*i* constitutes one member of the first screw part 8. The female screw 3*i* is disposed across a predetermined interval along the axial direction as a first female screw.

Between the distal end of the tube hole 3*g* and the stick-like cosmetic material hole 3*f*, the above-described groove forming section G is disposed. The groove forming section G is disposed corresponding to an interval where the projection 4*n* of the pipe member 4 (The details are described later) moves. This groove forming section G includes a plurality of (here, four pieces) grooves 3*n* and a convex part 3*p*. The grooves 3*n* are equally arranged side by side circumferentially, extend in the axial direction, and are installed consecutively to the tube hole 3*g*. The convex part 3*p* is formed between the grooves 3*n* and 3*n*, which are arranged circumferentially, and installed consecutively to the stick-like cosmetic material hole 3*f*.

The inner diameters of the tube hole 3*g* and the grooves 3*n* installed consecutively to this tube hole 3*g* are the identical diameter. The inner diameters of the stick-like cosmetic material hole 3*f* and the convex part 3*p* installed consecutively to this stick-like cosmetic material hole 3*f* are the identical diameter. Thus, at the leading tube 3, the plurality of grooves 3*n* extending frontward from the tube hole 3*g* by a predetermined length are separately disposed circumferentially at the tip end of the inner peripheral surface. Distal ends (stepped surfaces) 3*r* constituting the grooves 3*n* are the stepped surfaces corresponding to the advance limit of the pipe member 4.

The leading tube 3 with this structure is constituted as follows as illustrated in FIG. 3. The insertion part is inward inserted from the front side of the container main body 1. The collar part 3*x* is butted against the top end surface of the container main body 1. The concavo-convex part 3*d* engages the convexo-concave part 1*a* of the container main body 1 in the axial direction. Thus, the leading tube 3 is mounted rotatable to the container main body 1 and immovable in the axial direction.

As illustrated in FIG. 19, the ratchet spring member 7 has an approximately cylindrical shape. The intermediate part coupling a ratchet part 7*a* on the distal end side and a rear end part 7*b* is a spring part 7*c* extendable in the axial direction. Here, the spring part 7*c* is a resin spring integrally molded with the ratchet part 7*a* and the rear end part 7*b* and is constituted approximately in a spiral pattern.

At the top end surface of the ratchet part 7*a*, a plurality of ratchet teeth 7*x* are circumferentially arranged side by side. The ratchet teeth 7*x* engage the screw member 5 by ratchet.

At the outer peripheral surface of the ratchet part 7*a*, a plurality of (here, eight pieces) protrusions 7*d* extending in the axial direction are equally arranged side by side circumferentially. The protrusions 7*d* engage the grooves 1*c* of the container main body 1 in the rotation direction. At the outer peripheral surface of the rear end part 7*b* as well, a plurality of (here, four pieces) protrusions 7*e* extending in the axial direction are equally arranged side by side circumferentially. The protrusions 7*e* engage the grooves 1*c* of the container main body 1 in the rotation direction. The protrusions 7*e* of the rear end part 7*b* are disposed on the extended line of the protrusions 7*d* of the ratchet part 7*a*.

The ratchet spring member 7 having such constitution is, as illustrated in FIG. 3, inward inserted from the front side of the container main body 1. The rear end surface of the ratchet spring member 7 is butted against the top end surfaces 1*b* of the protrusions 1*f* of the container main body 1. The protrusions 7*d* of the ratchet part 7*a* and the protrusions 7*e* of the rear end part 7*b* engage the grooves 1*c* of the container main body 1 in the rotation direction. Thus, the ratchet spring member 7 is mounted synchronously rotatable to the container main body 1, the spring part 7*c* is mounted extendable in the axial direction, and the ratchet part 7*a* is mounted movable in the axial direction.

As illustrated in FIG. 16 to FIG. 18, the screw member 5 has an approximately cylindrical shape. The screw member 5 has a male screw (spiral projection) 5*e* as a first male screw. The male screw 5*e* is disposed at the middle of the outer peripheral surface in the axial direction. The male screw 5*e* constitutes the other member of the first screw part 8 and is screwed with the female screw 3*i* of the leading tube 3. In the inner peripheral surface, a female screw 5*j* constituting the one member of the second screw part 9 is disposed on the front side of the screw member 5. The female screw 5*j* is disposed as a second female screw across a predetermined interval along the axial direction.

The rear end part of the screw member 5 is a diameter enlarged part 5*c*. The diameter forward from the rear end part is enlarged. A plurality of ratchet teeth 5*x* are arranged side by side at the rear end surface of this diameter enlarged part 5*c* circumferentially. The ratchet teeth 5*x* mesh with the ratchet teeth 7*x* of the ratchet spring member 7 circumferentially. One of these ratchet teeth of the ratchet teeth 7*x* and 5*x* allow the rotation of the other ratchet teeth only in one direction. Here, the rotation of one ratchet teeth in the feed direction (advance) is allowed, while the rotation of the one ratchet teeth in the feedback direction (retreat) is not allowed.

At the tip end of the screw member 5, a pair of small windows 5*a* is opposedly open. The small windows 5*a* communicate between the inside and the outside. At the inner peripheral surface on the front side of these small windows 5*a*, lock convex parts 5*b* project to the axial direction. The lock convex parts 5*b* engage the pipe member 4 in the axial direction.

The screw member 5 having such constitution is, as illustrated in FIG. 3, inward inserted from the front side of the container main body 1. The top end surface of the diameter enlarged part 5*c* abuts on the rear end part of the leading tube 3 and is pushed. This causes the ratchet teeth 5*x* to mesh with the ratchet teeth 7*x* of the ratchet spring member 7. This compresses the spring part 7*c* of the ratchet spring member 7. Then, the male screw 5*e* is screwed with the female screw 3*i* of the leading tube 3, thus constituting the first screw part 8. The contact of the top end surface of the diameter enlarged part 5*c* to the rear end part of the leading tube 3 may correspond to the advance limit of the screw member 5 (pipe member 4).

The movable body 6 has the piston 6*x* at the distal end and a shaft part 6*y*. The shaft part 6*y* locates at the rear end of this piston 6*x* and elongates in the axial direction. The shaft part 6*y* has a pressing part 6*a* at the tip end. The pressing part 6*a* enters into a concave part 6*z*, which is depressedly disposed at the rear end of the piston 6*x*, to extrude this piston 6*x*. As illustrated in FIG. 20, the shaft part 6*y* has a male screw (spiral projection) 6*b* as a second male screw. The male screw 6*b* is disposed from the rear end to the middle of the pressing part 6*a* in the axial direction at the outer peripheral surface. The male screw 6*b* constitutes the other member of the second screw part 9. The male screw 6*b* is screwed with the female screw 5*j* of the screw member 5. At the rear end part of the movable body 6, convex parts 6*c* are disposed. The convex parts 6*c* extend in a cross direction viewed from the axial direction. The convex parts 6*c* engage the protrusions 1*f* of the container main body 1 in the rotation direction.

As illustrated in FIG. 2 and FIG. 3, the movable body 6 having such constitution is inward inserted to the container main body 1, the ratchet spring member 7, and the screw member 5. As illustrated in FIG. 12, the respective convex parts 6*c* at the rear end part of the movable body 6 enter between the protrusions if and if of the container main body 1. This mounts the movable body 6 so as to be synchronously rotatable to the container main body 1 and movable in the axial direction. As illustrated in FIG. 3, the male screw 6*b* is screwed with the female screw 5*j* of the screw member 5, thus constituting the second screw part 9. Regarding this second screw part 9 and the above-described first screw part 8, compared with a lead of the second screw part 9, a lead of the first screw part 8 is larger.

As illustrated in FIG. 3, the pipe member 4 has an approximately cylindrical shape. The stick-like cosmetic material M is filled into the tube hole. This stick-like cosmetic material M is almost closely housed in the pipe member 4 so as to be slidable. As illustrated in FIG. 21 and FIG. 22, at the rear end part of the pipe member 4, an annular convex part 4*a* is disposed. The convex part 4*a* engages the lock convex parts 5*b* in front of the small windows 5*a* of the screw member 5 in the axial direction. At the outer peripheral surface on the front side with respect to the convex part 4*a* of the pipe member 4, a groove 4*b* is disposed. When the pipe member 4 moves, an O-ring 11 is mounted to the groove 4*b*. The O-ring 11 is disposed at the inner peripheral surface of the leading tube 3 for appropriate sliding. Among annular front and rear convex parts 4*c* and 4*d* forming the groove 4*b*, the convex part 4*d* on the rear side butts against the top end surface of the screw member 5. The convex part 4*d* sandwiches the tip end of the screw member 5 with the convex part 4*a*, which is close to the rear end part, in the axial direction. At the convex part 4*c*, which is at the front side on the outer peripheral surface of the pipe member 4, a plurality of (here, four pieces) protrusions 4*e* are equally arranged side by side circumferentially. The protrusions 4*e* extend forward from the front side surface of this convex part 4*c* by a predetermined length. The protrusions 4*e* enter into the grooves 3*h* of the leading tube 3 to engage the grooves 3*h* in the rotation direction.

A plurality of (here, four pieces) projections 4*n* are equally disposed circumferentially at the distal end of the pipe member 4. The projections 4*n* extend frontward in the axial direction and enter into the grooves 3*n* of the leading tube 3. Accordingly, the convex part 3*p* of the leading tube 3 enters into grooves 4*p* between the projections 4*n* and 4*n*, which are circumferentially arranged at the pipe member 4. These projections 4*n* are formed by extending the distal end of the pipe member 4 frontward as it is. Accordingly, the inner diameters of the projections 4*n* and an inner diameter of a part rearward of these projections 4*n* are the identical diameter, being a diameter where the stick-like cosmetic material M slides. The inner diameters of these projections 4*n* and the inner diameter of the above-described convex part 3*p* of the leading tube 3 are also the identical diameter.

As illustrated in FIG. 23 to FIG. 25, the rear end part of the pipe member 4 having such constitution is inward inserted to the tip end of the screw member 5. The rear end surface of the convex part 4*d* on the rear side of the pipe member 4 is butted against the top end surface of the screw member 5. The convex parts 4*a* enter into the small windows 5*a* of the screw member 5 to engage the lock convex parts 5*b* in the axial direction (see FIG. 24). Additionally, the tip end of the screw member 5 is sandwiched between these convex parts 4*a* and convex parts 4*d*. Thus, the pipe member 4 and the screw member 5 are immovably mounted in the axial direction.

The pipe member 4 coupling the screw member 5 is, as illustrated in FIG. 3, inward inserted from the rear side of the tube hole 3*g* of the leading tube 3. The protrusions 4*e* enter into the grooves 3*h* of the leading tube 3 to engage the grooves 3*h* in the rotation direction. Thus, the pipe member 4 is unrotatably mounted to the leading tube 3 and movable in the axial direction. With this state, as illustrated in FIG. 5, FIG. 10, and FIG. 11, the projections 4*n* on the distal end side of the pipe member 4 enter into the grooves 3*n* of the leading tube 3. The convex parts 3*p* of the leading tube 3 are also in a state of entering into the grooves 4*p*. A distal end 4*r* of the projection 4*n* of this pipe member 4 moves within the above-described groove forming section G (advances or retreats). As illustrated in FIG. 3, the piston 6*x* at the distal end of the movable body 6 enters into the rear end of the pipe of the pipe member 4 by being pressed by the pressing part 6*a*.

As illustrated in FIG. 3, in the initial state, the screw member 5 reaches a forward screw limit by the first screw part 8, and the pipe member 4 is in a state positioned at the advance limit. Specifically, with the pipe member 4, as illustrated in FIG. 5, the distal end 4*r* of the projection 4*n* at the distal end of the pipe member 4 butts against the distal end 3*r* of the groove 3*n* of the leading tube 3. As the position of the advance limit for the pipe member 4, a state where the distal end of the protrusion 4*e* on the rear end side of the pipe member 4 butts against the distal end 3*j* of the groove 3*h* of the leading tube 3, or a state where a rear end 4*s* of the groove 4*p* of the pipe member 4 butts against a rear end 3*s* of the convex part 3*p* of the leading tube 3 may be employed.

With this state, in the groove forming section G, the projection 4*n* of the pipe member 4 and the groove 3*n* of the leading tube 3; and the groove 4*p* of the pipe member 4 and the convex part 3*p* of the leading tube 3 are in close contact without gap. The projection 4*n* of the pipe member 4 and the convex part 3*p* of the leading tube 3 form a flush surface of no step, a surface where the stick-like cosmetic material M can slide free from problem.

As illustrated in FIG. 3, the rear end surface of the piston 6*x* of the movable body 6 locates in the pipe member 4 so as to be almost a flush surface with the rear end surface of the pipe member 4. With this state, the stick-like cosmetic material M locates such that the top end surface becomes the flush surface with an opening 3*t* (distal end of the stick-like cosmetic material hole 3*f*) at the distal end of the leading tube 3.

This stick-like cosmetic material M is filled in the container in the following method. Specifically, with the stick-like cosmetic material feeding container 100 in the initial state stood, a melted cosmetic material is injected into the container through the opening 3*t* at the distal end of the leading tube 3 to fill the melted cosmetic material up to this opening 3*t*.

At this time, as described above, in the groove forming section G, the projection 4*n* of the pipe member 4 and the groove 3*n* of the leading tube 3; and the groove 4*p* of the pipe member 4 and the convex part 3*p* of the leading tube 3 are in close contact without gap. Accordingly, the inner peripheral surface of the pipe is gapless; therefore, the melted cosmetic material is finely filled in the pipe.

When the melted cosmetic material is cooled and hardened, the stick-like cosmetic material M is filled in the pipe member 4 and in the stick-like cosmetic material hole 3*f* of the leading tube 3 whose rear ends are covered with the piston 6*x*. Alternatively, the already completed stick-like cosmetic material M may be filled by being fitted by insertion through the opening 3*t* at the distal end of the leading tube 3.

The user purchases the stick-like cosmetic material feeding container with such constitution as the above-described stick-like cosmetic material feeding container 100 in the initial state, which is illustrated in FIG. 2 and FIG. 3.

With this state, as illustrated in FIG. 3 to FIG. 5, the stick-like cosmetic material M is supported by the whole circumference by the inner peripheral surface of the pipe member 4 at a part rearward of the projection 4*n* of the pipe member 4. At the stick-like cosmetic material hole 3*f*, the stick-like cosmetic material M is supported by the whole circumference by the inner peripheral surface of this stick-like cosmetic material hole 3*f*. In the groove forming section G, the stick-like cosmetic material M is supported by the whole circumference by the inner peripheral surface constituted of the projections 4*n* of the pipe member 4 and the grooves 3*n* of the leading tube 3; and the grooves 4*p* of the pipe member 4 and the convex parts 3*p* of the leading tube 3 in close contact without gap. Thus, the stick-like cosmetic material M is protected.

When the user relatively rotates the container main body 1 and the leading tube 3 in the feed direction, for example, when the user grips the leading tube 3 and rotates the container main body 1, the container main body 1, the movable body 6, and the ratchet spring member 7 are synchronously rotate.

At this time, by biasing force by the spring part 7*c* of the ratchet spring member 7, the ratchet teeth 5*x* and 7*x* engage. However, the screw member 5 locates at the advance limit by the first screw part 8 and therefore any further advance is blocked. Accordingly, if the user further continues the rotation operation in the feed direction, with the rotation of the screw member 5 in the feed direction blocked, the ratchet teeth 7*x* of the ratchet spring member 7, which synchronously rotate with the container main body 1, idles with respect to the ratchet teeth 5*x* of the screw member 5. In association with this idling, a click sounding clickety-clack and a clicking feel are generated.

Simultaneous with this, the movable body 6, which synchronously rotates with the container main body 1, rotates in the feed direction. Between the movable body 6 and the screw member 5, which stops rotating, the screwing action by the second screw part 9 is activated. As illustrated in FIG. 6 to FIG. 8, the movable body 6 advances, and the piston 6*x* extrudes the stick-like cosmetic material M in the pipe member 4 (see FIG. 6). At this time, compared with the lead of the first screw part 8, the lead of the second screw part 9 is designed small. Accordingly, the movable body 6 is fed slowly following the small lead of the second screw part 9, and the stick-like cosmetic material M is appropriately extruded from the pipe member 4. Thus, the stick-like cosmetic material M appropriately appears from the opening 3*t* of the leading tube 3, being ready for use. At the rotation operation to cause this stick-like cosmetic material M to appear, the above-described click and the clicking feel are given to the user. This allows preferably feeding the stick-like cosmetic material M, ensuring the use for application.

After the application, when the user relatively rotates the container main body 1 and the leading tube 3 in the feedback direction, for example, when the user grips the leading tube 3 and rotates the container main body 1, the container main body 1, the movable body 6, and the ratchet spring member 7 synchronously rotate.

Here, as described above, the ratchet teeth 5*x* and 7*x* does not allow the rotation of one ratchet teeth in the feedback direction. Accordingly, the screw member 5 and the ratchet spring member 7 integrally rotate in the feedback direction. Thus, between the screw member 5 and the leading tube 3, the screwing action by the first screw part 8 is activated. As illustrated in FIG. 9 to FIG. 11, the screw member 5 retreats together with the pipe member 4. The user continues the rotation operation until the distal end of the stick-like cosmetic material M sinks from the opening 3*t* of the leading tube 3 (see FIG. 9).

At this time, compared with the lead of the second screw part 9, the lead of the first screw part 8 is designed large. Therefore, following the large lead of the first screw part 8, the screw member 5 and the pipe member 4 are quickly fed back.

With this state, the pipe member 4 retreats from the advance limit and the stick-like cosmetic material M projects forward from the distal end 4*r* of the projection 4*n* of the pipe member 4 (see FIG. 9).

With this state, as illustrated in FIG. 10 and FIG. 11, when the stick-like cosmetic material M is at the position rearward more than the groove forming section G and the projections 4*n* are at the positions circumferentially arranged side by side, the stick-like cosmetic material M is circumferentially supported by the plurality of portions by the inner surfaces of the projections 4*n* of the pipe member 4. At the stick-like cosmetic material hole 3*f*, the stick-like cosmetic material M is supported by the whole circumference by the inner peripheral surface of this stick-like cosmetic material hole 3*f*. In the groove forming section G, at the tip ends of the projections 4*n* and the interval where the tip ends of these projections 4*n* are adjacent to the rear end parts of the convex parts 3*p* of the leading tube 3 and therefore the tip ends and the rear end parts circumferentially overlap, the stick-like cosmetic material M is supported by the whole circumference by the inner peripheral surfaces of the projections 4*n* and the inner surfaces of the convex parts 3*p*. In the groove forming section G, at the part frontward with respect to the interval circumferentially overlapping, the stick-like cosmetic material M is circumferentially supported by the plurality of portions by the inner surfaces of the convex parts 3*p* of the leading tube 3. Thus, the stick-like cosmetic material M is protected. As described above, such protection configuration is identical until the screw member 5 and the pipe member 4 reach the advance limit.

With the distal end of the stick-like cosmetic material M sunk from the opening 3*t* of the leading tube 3, if the user continues the rotation operation, the screwing action by the first screw part 8 further retreats the screw member 5, and from the rear end of the female screw 3*i* of the leading tube 3, the distal end of the male screw 5*e* of the screw member 5 is disengaged, being an screw released state. However, the screw member 5 is biased forward by the spring part 7*c* of the ratchet spring member 7. Therefore, the distal end of the male screw 5*e* of the screw member 5 is pressed to the rear end of the female screw 3*i* of the leading tube 3, the screw member 5 immediately recovering to the screwed state.

Afterwards, when the user relatively rotates the container main body 1 and the leading tube 3 in the feed direction, for example, when the user grips the leading tube 3 and rotates the container main body 1, the ratchet teeth 5*x* and 7*x* strongly engage by the biasing force by the spring part 7*c* of the ratchet spring member 7. Since the screw member 5 and the ratchet spring member 7 can synchronously rotate, the container main body 1 and the movable body 6 synchronously rotate with the screw member 5 and the ratchet spring member 7. This activates the screwing action by the first screw part 8. The screw member 5 advances together with the pipe member 4 and the movable body 6. When the screw member 5 reaches the advance limit, any further advance of the screw member 5 is blocked and the screwing action by the first screw part 8 stops.

At this time, in the case where the tip end of the stick-like cosmetic material M projects from the opening 3*t* of the leading tube 3 by a desired amount, the stick-like cosmetic material M is provided for application with the state. Meanwhile, in the case where the tip end of the stick-like cosmetic material M is not projected from the opening 3*t* of the leading tube 3 by the desired amount, the user further relatively rotates the container main body 1 and the leading tube 3 in the feed direction. Thus, similar to the above-described constitution, the screwing action by the second screw part 9 is activated to advance the movable body 6. Then, the stick-like cosmetic material M is extruded by the desired amount, ensuring providing the stick-like cosmetic material M for application.

Accordingly, this embodiment is constituted as follows. At the distal end of the pipe member 4, the plurality of projections 4*n* are disposed circumferentially. The projection 4*n* extends frontward in the axial direction. At the tip end of the leading tube 3, the groove forming section G is disposed. The groove forming section G includes the plurality of grooves 3*n* circumferentially in the inner peripheral surface. The grooves 3*n* extend in the axial direction. The projection 4*n* of the pipe member 4 enters the groove 3*n*. At the leading tube 3, the inner diameter of the convex part 3*p* between the grooves 3*n* and 3*n* circumferentially arranged and the inner diameter of the pipe part that houses the projection 4*n* of the pipe member 4 and the stick-like cosmetic material M rearward with respect to this projection 4*n* are identical size. A constitution where an advance or a retreat of the pipe member 4 moves the distal ends 4*r* of the projections 4*n* of the pipe member 4 within the groove forming section G of the leading tube 3 is employed. Even if the distal ends 4*r* of the projections 4*n* of the pipe member 4 retreat rearward with respect to the distal ends 3*r* of the grooves 3*n* of the leading tube 3 (even if the distal ends 3*r* retreat more than the advance limit), this constitution circumferentially supports the stick-like cosmetic material M projecting from the projections 4*n* of the pipe member 4 at a plurality of portions by inner surfaces of the convex parts 3*p* between the grooves 3*n* and 3*n* in the groove forming section G of the leading tube 3. Accordingly, even if the stick-like cosmetic material feeding container 100 is impacted or vibrated, the snap of the stick-like cosmetic material M can be prevented.

Although the present invention has been specifically described on the basis of its embodiments; however, the present invention is not limited to the above embodiments. For example, the embodiments describe the application to the stick-like cosmetic material feeding container 100 using the stick-like cosmetic material M as the stick-like material as especially preferable embodiment. However, it is apparent that the present invention is applicable to a stick-like material feeding container such as a writing material where, for example, a lead pencil is used as the stick-like material.

What is claimed is:

1. A stick-like material feeding container, comprising:

a leading tube that has an opening at a distal end, the leading tube having a first female screw in an inner peripheral surface;

a container main body to which the leading tube is mounted to be relatively rotatable;

a pipe member disposed in the leading tube, a stick-like material being filled into a pipe part of the pipe member;

a movable body that includes a piston and a shaft part, the piston being movable in the pipe member to extrude the stick-like material, the shaft part having a second male screw at an outer peripheral surface; and a screw member that includes a first male screw at an outer peripheral surface and a second female screw at an inner peripheral surface, the first male screw being screwed with the first female screw of the leading tube to constitute a first screw part, the second female screw being screwed with the second male screw of the movable body to constitute a second screw part, wherein a relative rotation of the leading tube and the container main body advances or retreats the screw member together with the pipe member by a screwing action by the first screw part, meanwhile, when the screw member and the pipe member advance for a predetermined distance, a screwing action by the second screw part advances the movable body to extrude the stick-like material to ensure projecting the stick-like material from the opening of the leading tube, at a distal end of the pipe member, a plurality of projections are disposed circumferentially, the plurality of projections extending frontward in an axial direction, at a tip end of the leading tube, a groove forming section is disposed, the groove forming section including a plurality of grooves circumferentially in an inner peripheral surface, the plurality of grooves extending in an axial direction, each of the plurality of projections of the pipe member respectively entering one of the plurality of grooves, an inner diameter of a convex part between the plurality of grooves circumferentially arranged at the tip end of the leading tube, an inner diameter of the plurality of projections at the distal end of the pipe member, and an inner diameter of a pipe part that houses the stick-like material rearward with respect to the plurality of projections of the pipe member are identical size, and the screwing action by the first screw part advances or retreats a distal end of the plurality of projections of the pipe member within the groove forming section.

* * * * *